US005432969A

United States Patent [19]

Oh

[11] Patent Number: 5,432,969

[45] Date of Patent: Jul. 18, 1995

[54] WASHING METHOD UTILIZING LOW FREQUENCY OSCILLATION

[75] Inventor: Dong Y. Oh, Kwangmyung-si, Rep. of Korea

[73] Assignee: L. G. Electronics Inc., Seoul, Rep. of Korea

[21] Appl. No.: 208,364

[22] Filed: Mar. 10, 1994

[30] Foreign Application Priority Data

Mar. 11, 1993 [KR] Rep. of Korea ..... 1993-3648

[51] Int. Cl.[6] ..... D06F 19/00

[52] U.S. Cl. ..... 8/159; 68/3 R; 68/3 SS

[58] Field of Search ..... 8/159; 68/3 R, 3 SS, 68/183, 171, 174

[56] References Cited

U.S. PATENT DOCUMENTS

| | | | |
|---|---|---|---|
| 3,048,994 | 8/1962 | Welter | 68/183 X |
| 3,087,776 | 4/1963 | Anderson | 8/159 |
| 3,134,990 | 6/1964 | Bodine | 8/159 |

FOREIGN PATENT DOCUMENTS

| | | | |
|---|---|---|---|
| 1256712 | 2/1961 | France | 68/3 SS |
| 701476 | 12/1953 | United Kingdom | 68/3 SS |

*Primary Examiner*—Philip R. Coe
*Attorney, Agent, or Firm*—Fish & Richardson

[57] ABSTRACT

A washing method and a washing apparatus capable of obtaining a washing or cleaning effect by mechanical energy obtained by cavitation phenomena or nonlinear oscillation of micro air bubbles generated during the resonance of a multi-phase medium using low frequency waves. The resonance phenomenon becomes accelerated and uniform by virtue of the injection of air bubbles in the tub or the provision of a sonic or ultrasonic oscillation unit, thereby enabling a superior washing performance to be obtained. Since the present invention eliminates use of any pulsator, it is possible to considerably reduce the phenomenon that clothes get twisted or tangled. As a result, few damage of clothes is generated. Moreover, the electric power consumption in washing or cleaning is greatly reduced.

23 Claims, 7 Drawing Sheets

WASHING METHOD UTILIZING LOW FREQUENCY OSCILLATION

BACKGROUND OF THE INVENTION

The present invention relates to a washing method and a washing apparatus utilizing low frequency oscillation wherein a washing is carried out by use of multi-phase medium consisting of water, detergent and air and being subjected to a resonance phenomenon at a specific frequency.

Generally, a washing machine includes a pulsator rotatable mounted at the lower portion of a washing tub and a motor mounted on a base of the machine and adapted to rotate the pulsator. As the pulsator rotates by repeated normal and reverse rotations of the motor at a speed reduced by a speed reducing mechanism, a washing water in the washing tub produces a heart water flow or a rotated water flow. Clothes contained in the washing tub are moved by the water flow. During the movement of clothes, friction generates to carry out a washing. Such a washing machine is of the washing type utilizing the intensity or movement of water flows. In this type, an washing effect is obtained by a combination of a mechanical energy of the shear force of fluid, the bending movement and frictional action of clothes with a chemical effect of a detergent.

However, such a conventional washing machine has the following problems:

First, clothes contained in the washing tub get easily twisted or tangled due to repeated agitating operations, namely, repeated normal and reverse rotations of the pulsator. As a result, a severe damage of clothes may occur.

Second, the solubility of the detergent achieved by the water flow is low. As a result, the consumption of the detergent is excessive, thereby resulting in contamination of rivers.

Third, clothes may be stained with the detergent not solved after the washing operation. The stained detergent may injure the user's skin.

Finally, a larger quantity of washing water and a more lengthened washing time are required for removal of the detergent not solved.

SUMMARY OF THE INVENTION

Therefore, an object of the invention is to provide a washing method and a washing apparatus capable of obtaining a washing or cleaning effect by mechanical energy obtained by cavitation phenomena or nonlinear oscillation of micro air bubbles generated during the resonance of a multi-phase medium using low frequency waves.

Another object of the invention is to provide a washing method and a washing apparatus capable of achieving an efficient washing by utilizing a resonance and yet using a minimum energy required for the resonance.

In accordance with one aspect, the present invention provides a washing method utilizing a low frequency oscillation, comprising the steps of: pouring clothes to be washed into a multi-phase medium contained in a tub of a washing machine, said multi-phase medium consisting of a water, a detergent and an air layer; and subjecting the multi-phase medium to a low frequency oscillation generated by an oscillator such that a resonance phenomenon is generated at a resonance frequency of the multi-phase medium so as to produce micro air bubbles in the multi-phase medium, whereby a washing is carried out by a combination of a mechanical energy obtained by cavitation phenomena and nonlinear oscillation of said micro air bubbles and a chemical effect of said detergent.

In accordance with another aspect, the present invention provides a washing apparatus comprising: a tub containing therein a multi-phase medium consisting of a water, a detergent and an air layer; a low frequency oscillator for generating a resonance phenomenon in said multi-phase medium contained in said tub; and drive means for low frequency oscillation for driving said low frequency oscillator.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

Figure 1:
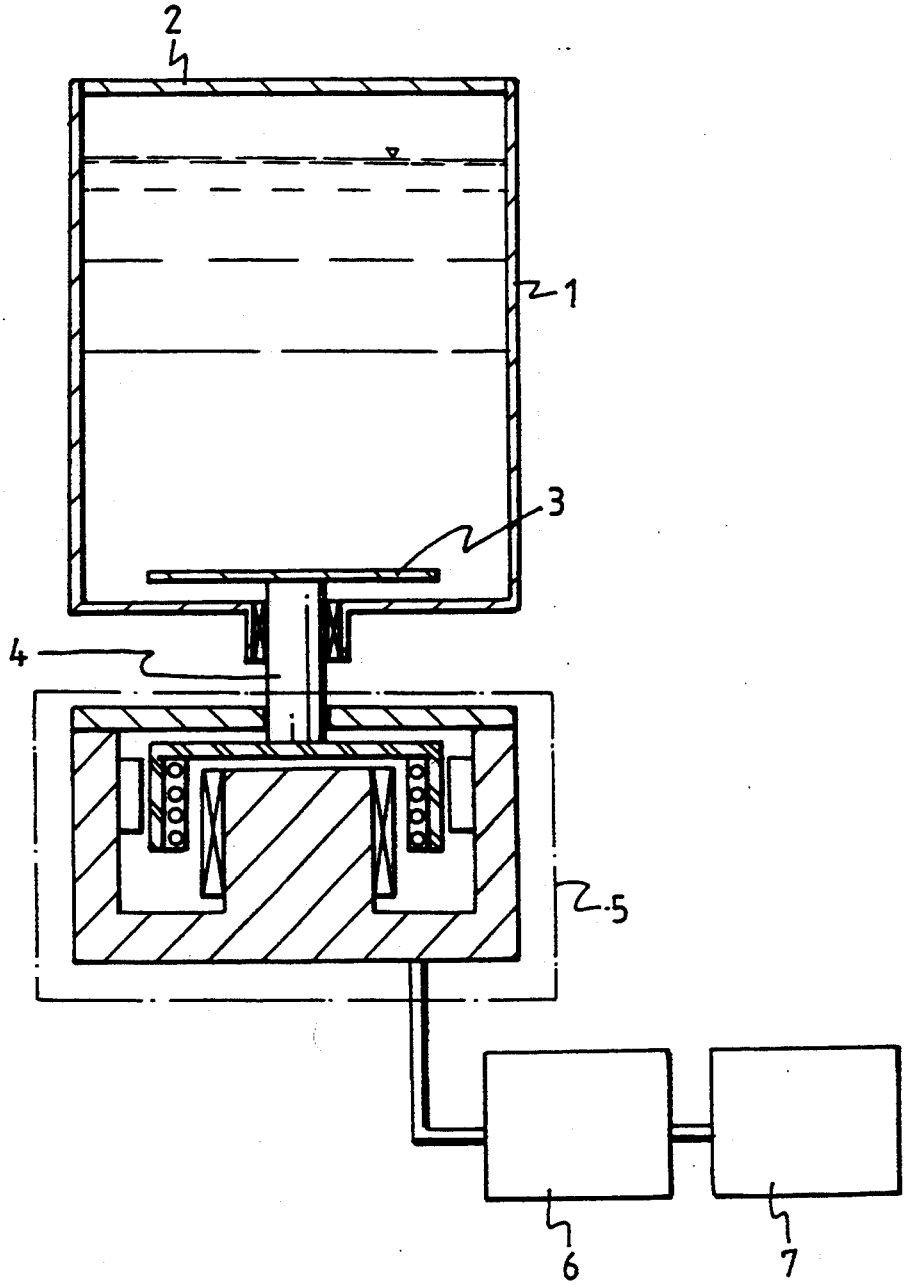
FIG. 1 is a schematic sectional view of a washing apparatus in accordance with a first embodiment of the present invention.

Referring to FIG. 1, there is illustrated a washing apparatus in accordance with a first embodiment of the present invention. As shown in FIG. 1, the washing apparatus comprises a tub 1 and an oscillator 3 for low frequency oscillation disposed at the lower portion of the tub 1. The oscillator 3 has a drive shaft 4 which is operatively connected to a drive unit 5 for low frequency oscillation for driving the oscillator 3. To the drive unit 5, a signal amplifier 6 and a signal oscillator 7 are electrically connected.

The tub 1 has an upper opening which is closed by a seal plate 2.

The low frequency oscillator 3 which is disposed at the lower portion of the tub 1 may have a flat plate shape, a cylindrical shape or other like shapes.

The drive unit 5 which is adapted to drive the low frequency oscillator 3 may be a linear motor or an electromagnetic actuator. Alternatively, the drive unit 5 may be an actuator which is of the type capable of transmitting mechanical vibrations using a cam and crank mechanism.

Where the linear motor is used as the drive unit 5 for low frequency oscillation, an advantage that the overall system can be easily constructed, even though the cost is increased. On the other hand, the electromagnetic actuator which is inexpensive has a disadvantage of causing the overall system to be complicated. Taking into consideration these points, a proper drive unit may be selected.

As the linear motor or the electromagnetic actuator 5 is driven in the washing apparatus of the first embodiment, the low frequency oscillator 3 connected to the drive shaft 4 operates and oscillates low frequency waves in a predetermined direction or in an inter-crossing direction in a three-dimensional space. By the low frequency waves, a multi-phase medium consisting of water, detergent and an air layer contained in the tub 1 generates a resonance phenomenon.

By virtue of the resonance phenomenon, micro air bubbles are generated in the multi-phase medium and they generate cavitation phenomena. The cavitation phenomena cooperates with a mechanical energy generated by non-linear oscillation of the low frequency oscillator 3 and a chemical effect of the detergent, thereby achieving an effective washing or cleaning.

In operation, the signal amplifier 6 and the signal oscillator 7 operate to make the oscillator 3 generate low frequency waves having an oscillating frequency band of 10 to 100 Hz, an amplitude of 2 to 25 mm and an angular rotation amplitude of 2° to 10°. They also serve to amplify current or voltage applied to the oscillator 3.

When the oscillating frequency band of the low frequency waves is less than 10 Hz, the oscillator 3 oscillates too rapidly. In this case, a deterioration in durability is generated. On the other hand, excessive energy is consumed at the oscillating frequency band of more than 100 Hz. Furthermore, the waves generated are adversely beyond the resonance band in the latter case.

At the amplitude of less than 2 mm and the angular rotation amplitude of less than 2°, the resonance phenomenon is hardly generated. On the other hand, the case involving the amplitude of more than 25 mm and the angular rotation amplitude of more than 10° is also undesirable because of an excessive energy consumption, even though there is no problem related to the resonance phenomenon.

Consequently, the reason why the oscillating frequency band of the oscillator 3 is ranged from 10 Hz to 100 Hz is to generate the resonance state. As the frequency of low frequency waves generated is increased in the above frequency band, upper air of the multi-phase medium in the tub 1 penetrates the water against the surface tension of the water and forms air bubbles in the multi-phase medium such that the formed air bubbles are present throughout the whole height of the multi-phase medium, thereby generating a resonance state. When the oscillating frequency range of the oscillator is enlarged under this state, the air bubbles disappears from the lower portion of the multi-phase medium and then from the resonated region. Finally, the multi-phase medium recovers its original state in which air bubbles are present only at the upper portion of the water. As a result, a satisfactory washing effect can not be obtained.

Figure 2:
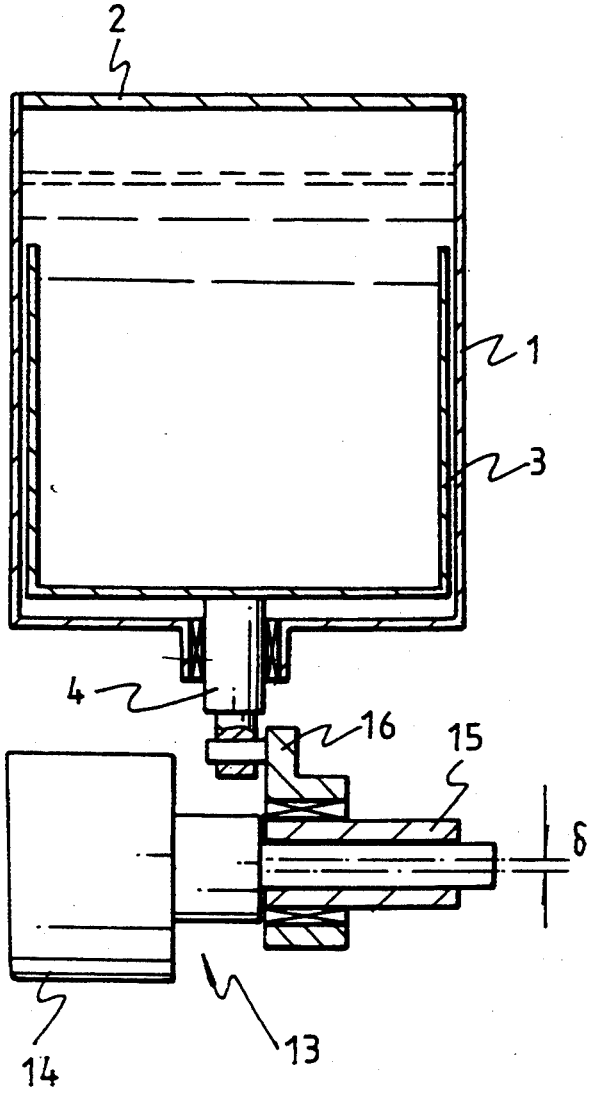
FIG. 2 is a schematic sectional view of the washing apparatus of the first embodiment which includes an oscillator and a drive unit for low frequency oscillation both having different constructions from those of FIG. 1.

FIG. 2 is a schematic sectional view of the washing apparatus which includes an oscillator and a drive unit for low frequency oscillation both having different constructions from those of FIG. 1. In this case, the low frequency oscillator 3 has a container shape. As the drive unit for low frequency oscillation, an actuator of the type capable of transmitting mechanical vibrations is used, as different from the case of FIG. 1 using the linear motor or the electromagnetic actuator.

The drive unit includes a motor 14 for generating a drive force, a crank 15 eccentrically connected to a shaft of the motor 14, and a cam 16 operatively connected between the drive shaft 4 of the oscillator 3 and the crank 15 and adapted to transmit an eccentric rotation force from the crank to the oscillator 3.

The crank 15 has an eccentric amount $\delta$ indicative of the distance between a center line of the crank 15 and a center line of the motor shaft. In accordance with the present invention, the eccentric amount $\delta$ is 1 to 12.5 mm. This is because the amplitude of frequency waves generated from the oscillator 3 is 2 to 25 mm.

When the crank 15 rotates eccentrically at an eccentric amount of $2\delta$ by the drive force of the motor 14, the eccentric rotation force generated from the 15 is transmitted to the oscillator 3 through the cam 16, so that the oscillator 3 can oscillates in an amplitude range of 2 to 25 mm. Accordingly, the washing apparatus of FIG. 2 can operate to achieve the same washing effect as that of FIG. 1.

Figure 3:
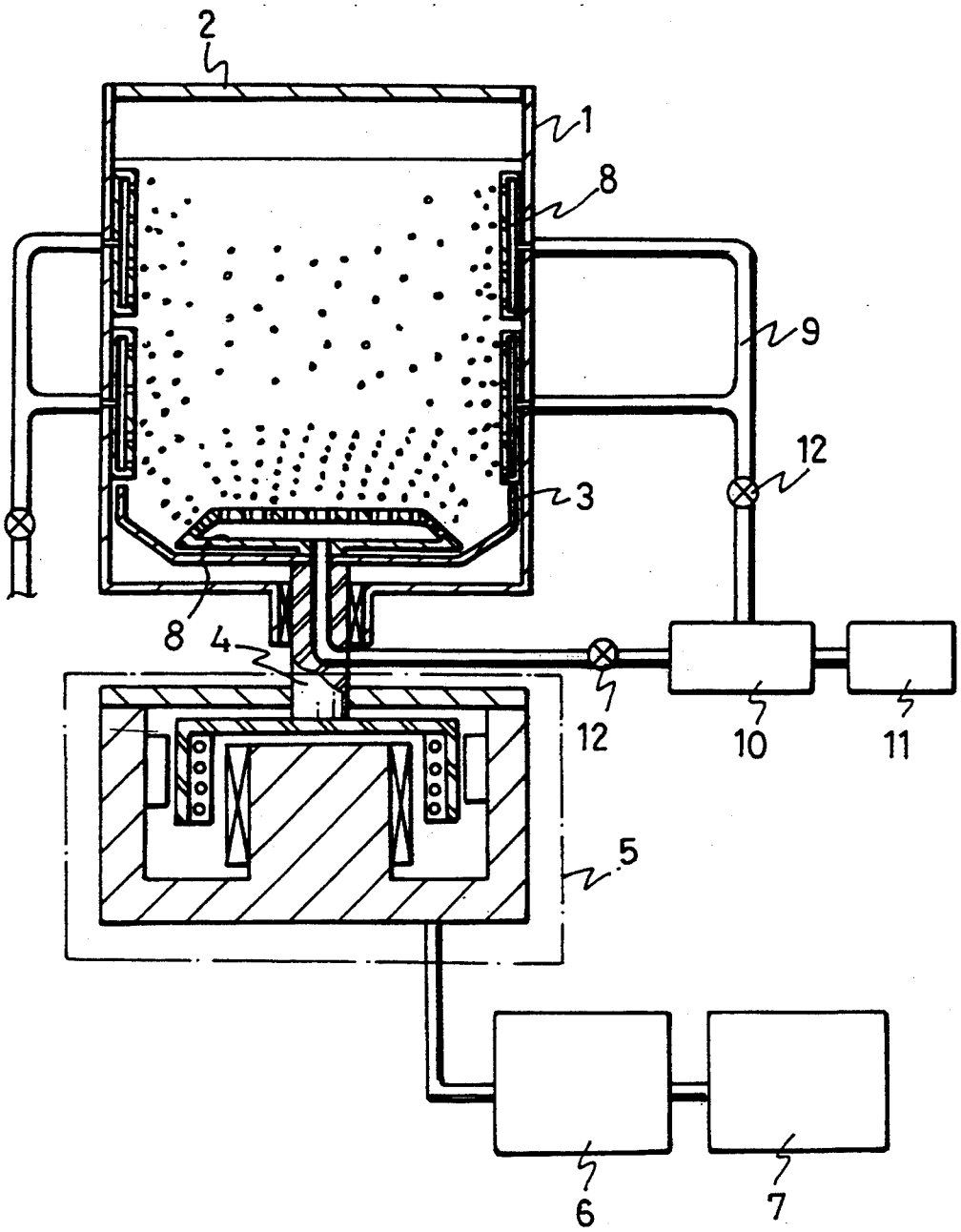
FIG. 3 is a schematic sectional view of a washing apparatus in accordance with a second embodiment of the present invention.

Referring to FIG. 3, there is illustrated a washing apparatus in accordance with a second embodiment of the present invention. In accordance with this embodiment, air injection members are provided at the tub as means for efficiently generating the resonance phenomenon of the multi-phase medium so that air can be injected into the tub through the air injection members.

That is, a plurality of air injection members 8 each having a plurality of ports are formed at the lower wall and the bottom wall of the tub 1, as shown in FIG. 3. The air injection members 8 are connected to an air pump or air compressor 10 by means of an air inlet tube 9. To the air pump or air compressor 10, a frequency controller 11 is connected.

In accordance with the second embodiment, a check valve 12 is also disposed in the air inlet tube 9. The check valve 12 serves to prevent air from reversely flowing in the air inlet tube 9 and prevent the multi-phase medium contained in the tub 1 from entering the air pump or air compressor 10 through the air inlet tube 9.

In operation of this washing apparatus, the air pump or air compressor 10 is driven to generate air bubbles while the low frequency oscillator 3 oscillates in the same manner as in the washing apparatus of the first embodiment. The generated air bubbles are then injected into the tub 1 through the air injection members 8. The injected air bubbles are abruptly expanded and then oscillated while being gradually shrunk, broken, merged into lager ones, or moved.

The frequency controller 11 oscillates the air pump or air compressor 10 at the same frequency or harmonics as the resonance frequency of the multi-phase medium so as to generate air bubbles. Diameters of air bubbles injected into the multi-phase medium are determined by the ports of air injection members 8. Preferably, the diameter of each port of the air injection members 8 is in a range of 0.5 to 5 mm.

In this case, the size of the air bubbles generated is substantially identical to that of the air bubbles generated. by the resonance phenomenon caused by the oscillation of the low frequency oscillator. At this size of the micro air bubbles, the energy required for generating the resonance phenomenon is minimized while the vibration and the impact energy produced by the micro air bubbles are maximized.

Figure 4:
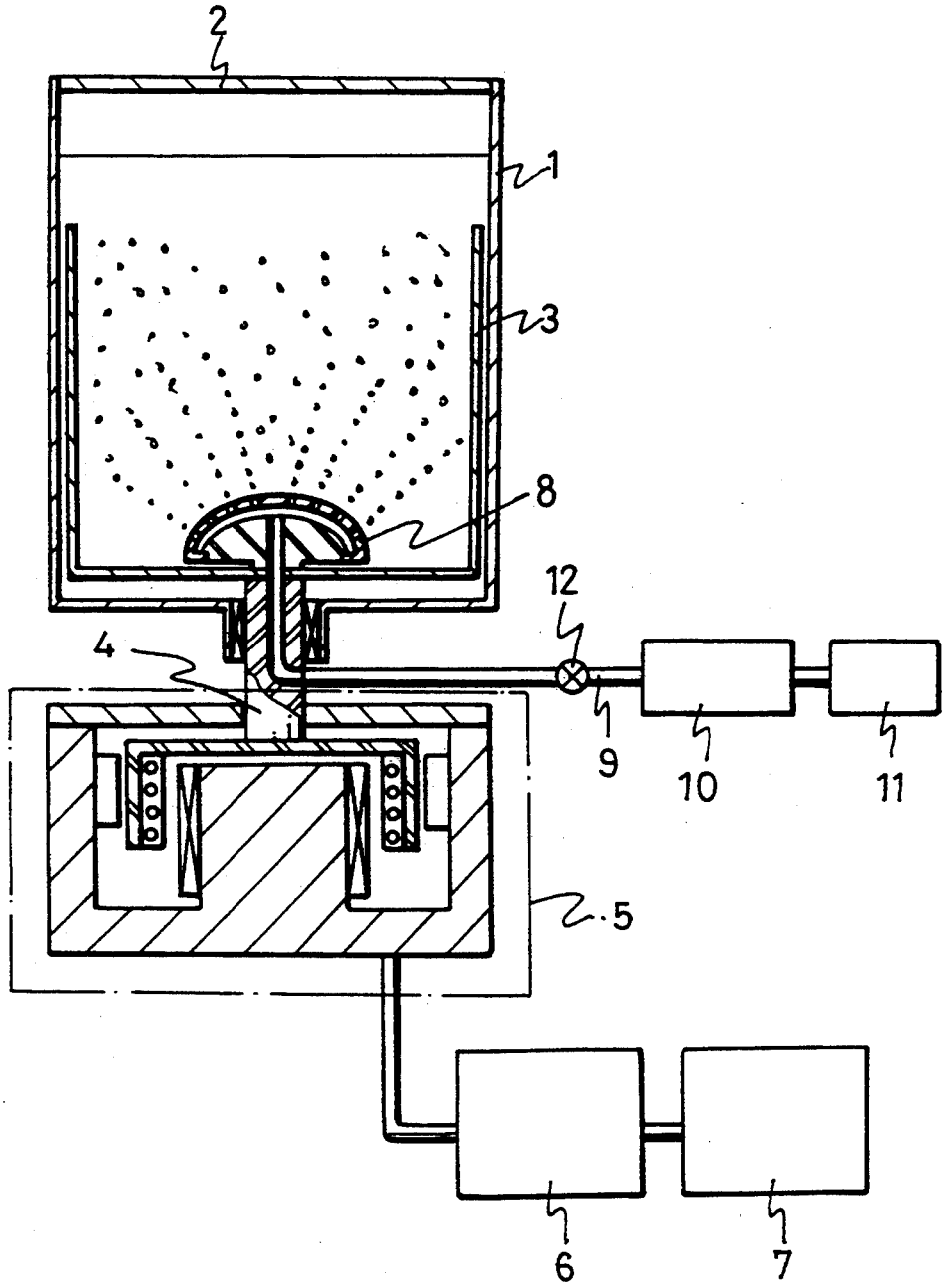
FIG. 4 is a schematic sectional view of the washing apparatus of the second embodiment which includes a single air injection member and an oscillator both having different constructions from those of FIG. 3.

FIG. 4 is a schematic sectional view of the washing apparatus of the second embodiment which includes a single air injection member and an oscillator both having different constructions from those of FIG. 3. In this case, the low frequency oscillator 3 has a container shape and the air injection member 8 is provided only at the lower wall of the tub 1. The air injection member 8 is connected to an air pump or air compressor 10 by means of an air inlet tube 9. To the air pump or air compressor 10, a frequency controller 11 is connected.

In this case, the air injection member 8 has a curved upper surface and a plurality of radially extending ports. With this construction, air bubbles emerging from the air injection member 8 are spread more widely in the tub 1.

Other constructions of this case are the same as those of FIG. 1 and, thus, detailed description thereof will be omitted.

Figure 5:
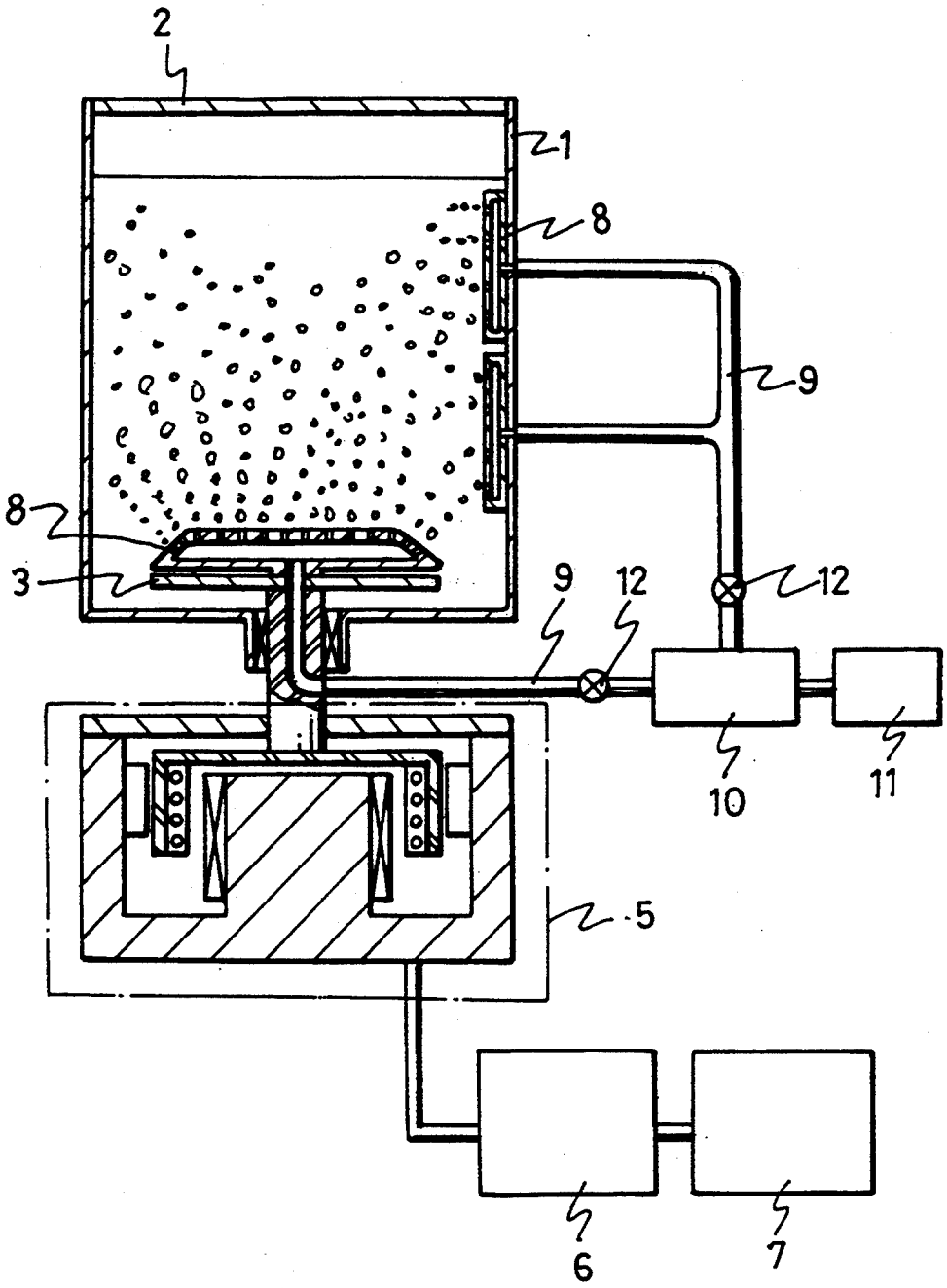
FIG. 5 is a schematic sectional view of the washing apparatus of the second embodiment which includes air injection members and a low frequency oscillator having a modified construction from those of FIG. 3.

FIG. 5 is a schematic sectional view of the washing apparatus of the second embodiment which includes air injection members and a low frequency oscillator having a modified construction from those of FIG. 3. In this case, the low frequency oscillator 3 has a flat plate shape and the air injection members 8 are provided at the lower wall and one side wall of the tub 1, respectively.

Figure 6:
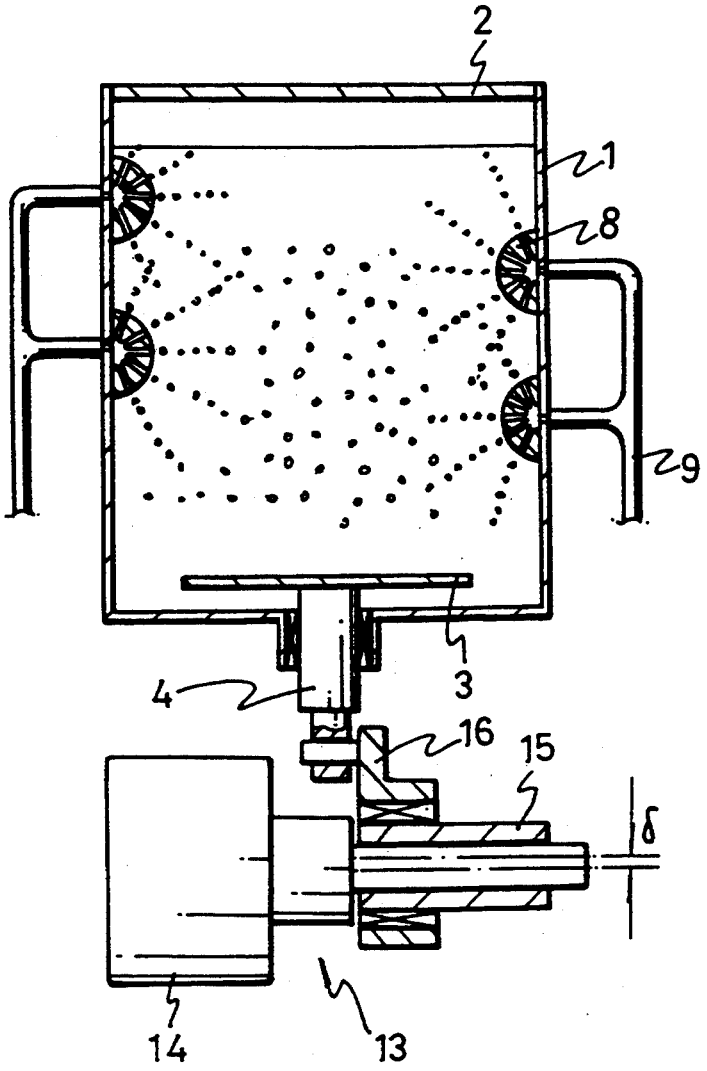
FIG. 6 is a schematic sectional view of the washing apparatus of the second embodiment in which an actuator of the type capable of transmitting mechanical vibrations is used.

FIG. 6 is a schematic sectional view of the washing apparatus of the second embodiment in which an actuator 13 of the type capable of transmitting mechanical vibrations is used, as different from the cases of FIGS. 3 to 5 using the linear motor or the electromagnetic actuator. In this case, air injection members 8 are provided at both side walls of the tub 1.

The actuator 13 of the type capable of transmitting mechanical vibrations comprises a motor 14 for generating a drive force, a crank 15 eccentrically connected to a shaft of the motor 14 to rotate together with the motor shaft, and a cam 16 operatively connected between the drive shaft 4 of the oscillator 3 and the crank 15 and adapted to transmit the drive force from the crank 15 to the oscillator 3.

The crank 15 has an eccentric amount $\delta$ indicative of the distance between a center line of the crank 15 and a center line of the motor shaft. In this case, the eccentric amount $\delta$ is preferably 1 to 12.5 mm. The drive shaft 4 vibrates vertically within a distance corresponding to twice the eccentric amount, thereby causing the low frequency oscillator 3 to be oscillated.

As mentioned above, the air injection members 8 are disposed only at both side walls of the tub 1. Although not shown in FIG. 6, this washing apparatus also includes an air pump or air compressor for supplying air at the air injection members 8, a frequency controller and a check valve all of which have the same constructions as those of the above-mentioned cases.

Figure 7:
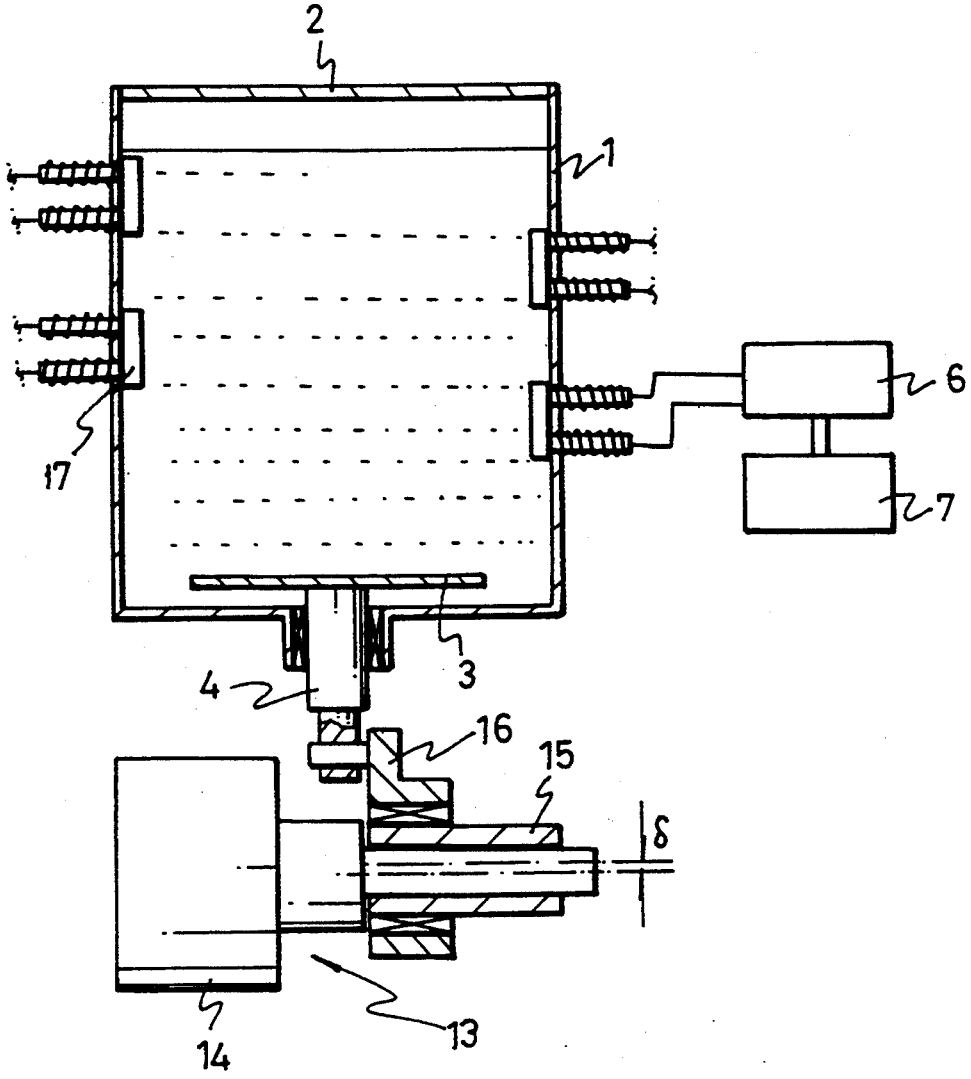
FIG. 7 is a schematic sectional view of a washing apparatus in accordance with a third embodiment of the present invention.

Referring to FIG. 7, there is illustrated a washing apparatus in accordance with a third embodiment of the present invention. In this case, an actuator of the type capable of transmitting mechanical vibrations is used to oscillate a low frequency oscillator. In place of the actuator of the above-mentioned type, of course, a linear motor or an electromagnetic actuator may be used, as in the case of FIG. 1.

As different from the cases of FIGS. 3 to 6 in which the air injection members 8 are provided at the tub 1, the washing apparatus of the third embodiment includes a drive mechanism 17 for sonic or ultrasonic oscillation as means for efficiently generating a resonance phenomenon of the multi-phase medium. The drive mechanism 17 oscillates the multi-phase medium together with low frequency waves. To the drive mechanism 17, a signal amplifier 6 and a signal oscillator 7 are connected.

The drive mechanism 17 for sonic or ultrasonic oscillation may be an electromagnetic actuator such as a solenoid unit or a linear motor, a speaker system, or a piezo electrical transducer (PZT) unit for ultrasonic oscillation.

Where The PZT unit is used, a magneto strictive transducer which is the current type may be used as an oscillation source for the PZT unit. Alternatively, the oscillation source may be a piezo electrical ceramics or a piezo electrical film which is the voltage type.

Where the electromagnetic actuator is used, a permanent magnet may be used as an operating element for oscillating sonic waves. In this case, the permanent magnet is moved as current flows in a coil wound around an electromagnetic element, particularly, a stator. Alternatively, sonic waves may be oscillated by flowing current in a moving coil used in place of the permanent magnet.

The signal amplifier 6 and the signal oscillator 7 both connected to the ultrasonic oscillation mechanism controls driving of the sonic or ultrasonic oscillation mechanism so that the oscillation mechanism can oscillate in a band of 1 to 50 KHz. The signal amplifier 6 and the signal oscillator 7 also serve to amplify current or voltage applied to the sonic or ultrasonic oscillation mechanism.

When the frequency band of generated waves is less than 1 KHz, the washing efficiency is degraded. On the other hand, the energy consumption is increased in the frequency band of more than 50 KHz, even though the same washing efficiency as in the frequency band of 1 to 50 KHz is obtained.

As the sonic or ultrasonic oscillation mechanism oscillates in the frequency band of 1 to 50 KHz, accelerated and uniform cavitation phenomena of micro air bubbles having a size of 0.2 to 5 mm are generated in the tub 1, thereby minimizing the energy required for the resonance as well as maximizing the vibration and impact energy generated by the micro air bubbles.

As apparent from the above description, the present invention provides a washing apparatus and a washing method capable of obtaining a washing or cleaning effect by mechanical energy obtained by cavitation phenomena or nonlinear oscillation of micro air bubbles generated during the resonance of a multi-phase medium using low frequency waves. In accordance with the present invention, the resonance phenomenon becomes accelerated and uniform by virtue of the injection of air bubbles in the tub or the provision of a sonic or ultrasonic oscillation unit. Accordingly, the present invention can obtain a superior washing performance over the prior art.

Since the present invention eliminates use of any pulsator, it is possible to considerably reduce the phenomenon that clothes get twisted or tangled. As a result, few damage of clothes is generated. Moreover, the electric power consumption in washing or cleaning is greatly reduced.

Although the preferred embodiment of the invention have been disclosed for illustrative purpose, those skilled in the art will appreciate that various modifications, additions and substitutions are possible, without departing from the scope and spirit of the invention as disclosed in the accompanying claim.

What is claimed is:

1. A washing method utilizing a low frequency oscillation, comprising the steps of:

pouring clothes to be washed into a multi-phase medium contained in a tub of a washing machine, said multi-phase medium consisting of a water, a detergent and an air layer; and subjecting the multi-phase medium to a low frequency oscillation generated by an oscillator such that a resonance phenomenon is generated at a resonance frequency of the multi-phase medium so as to produce micro air bubbles in the multi-phase medium, whereby a washing is carried out by a combination of a mechanical energy obtained by cavitation phenomena and nonlinear oscillation of said micro air bubbles and a chemical effect of said detergent.

2. A washing method in accordance with claim 1, wherein said oscillator oscillates in an oscillating frequency band of 10 to 100 Hz so as to have an oscillation amplitude of 2 to 25 mm.

3. A washing method in accordance with claim 1, wherein said oscillator oscillates in an oscillating frequency band of 10 to 100 Hz so as to have an rotation amplitude of 2° to 10°.

4. A washing method in accordance with claim 1, wherein said oscillator oscillates low frequency waves in one direction.

5. A washing method in accordance with claim 1, wherein said oscillator oscillates low frequency waves in inter-crossing directions in a three-dimensional space.

6. A washing method utilizing a low frequency oscillation, comprising the steps of:

pouring clothes to be washed into a multi-phase medium contained in a tub of a washing machine, said multi-phase medium consisting of a water, a detergent and an air layer; and subjecting said multi-phase medium to a low frequency oscillation generated by an oscillator while injecting air bubbles into the multi-phase medium such that a resonance phenomenon is generated at a resonance frequency of the multi-phase medium so as to produce micro air bubbles in the multi-phase medium, whereby a washing is carried out by a combination of a mechanical energy obtained by cavitation phenomena and nonlinear oscillation of said micro air bubbles and a chemical effect of said detergent.

7. A washing method in accordance with claim 6, wherein said oscillator oscillates in an oscillating frequency and of 10 to 100 Hz so as to have an oscillation amplitude of 2 to 25 mm.

8. A washing method in accordance with claim 6, wherein said oscillator oscillates in an oscillating frequency band of 10 to 100 Hz so as to have an rotation amplitude of 2° to 10°.

9. A washing method in accordance with claim 6, wherein said oscillator oscillates low frequency waves in one direction.

10. A washing method in accordance with claim 6, wherein said oscillator oscillates low frequency waves in inter-crossing directions in a three-dimensional space.

11. A washing method in accordance with claim 6, wherein said air bubbles injected into said multi-phase medium have a diameter of 0.5 to 5 mm such that the washing is carried out by a variation in diameter of the air bubbles.

12. A washing method in accordance with claim 11, wherein said injection of the air bubbles into the multi-phase medium is carried out at all parts of a peripheral surface of said tub.

13. A washing method in accordance with claim 11, wherein said injection of the air bubbles into the multi-phase medium is carried out at a lower portion of said tub.

14. A washing method in accordance with claim 11, wherein said injection of the air bubbles into the multi-phase medium is carried out at all parts of a peripheral surface and a lower portion of said tub.

15. A washing method in accordance with claim 11, wherein said injection of the air bubbles into the multi-phase medium is carried out at one side surface and a lower portion of said tub.

16. A washing method in accordance with claim 6, wherein said injection of the air bubbles into the multi-phase medium is carried out by an air pump or an air compressor at the same frequency or harmonics as the resonance frequency of the multi-phase medium.

17. A washing method in accordance with claim 6, wherein said injection of the air bubbles into the multi-phase medium is carried out at all parts of a peripheral surface of said tub.

18. A washing method in accordance with claim 6, wherein said injection of the air bubbles into the multi-phase medium is carried out at a lower portion of said tub.

19. A washing method in accordance with claim 18, wherein said injection of the air bubbles into the multi-phase medium is carried out in radial directions.

20. A washing method in accordance with claim 6, wherein said injection of the air bubbles into the multi-phase medium is carried out at all parts of a peripheral surface and a lower portion of said tub.

21. A washing method in accordance with claim 6, wherein said injection of the air bubbles into the multi-phase medium is carried out at one side surface and a lower portion of said tub.

22. A washing method utilizing a low frequency oscillation, comprising the steps of:

pouring clothes to be washed into a multi-phase medium contained in a tub of a washing machine, said multi-phase medium consisting of a water, a detergent and an air layer; and subjecting said multi-phase medium to a low frequency oscillation generated by an oscillator such that a resonance phenomenon is generated at a resonance frequency of the multi-phase medium, and simultaneously applying sonic or ultrasonic waves generated from a sonic or ultrasonic oscillation device to the multi-phase medium such that the resonance phenomenon is accelerated so as to produce micro air bubbles in the multi-phase medium, whereby a washing is carried out by a combination of a mechanical energy obtained by cavitation phenomena and nonlinear oscillation of said micro air bubbles and a chemical effect of said detergent.

23. A washing method in accordance with claim 22, wherein said sonic or ultrasonic oscillation device oscillates in an oscillating frequency band of 1 to 50 KHz.

* * * * *